US006035861A

United States Patent [19]

Copello

[11] Patent Number: 6,035,861

[45] Date of Patent: Mar. 14, 2000

[54] SYSTEM AND METHOD FOR USING HIDDEN HAIR COMBS TO ENHANCE HAIR APPEARANCE

[76] Inventor: Pamela Dale Copello, 110 Holiday La., River Vale, N.J. 07675

[21] Appl. No.: 09/193,705

[22] Filed: Nov. 17, 1998

[51] Int. Cl.[7] ..... A41G 3/00; A41G 5/00; A45D 24/00

[52] U.S. Cl. ..... 132/201; 132/200; 132/219; 132/105; 132/53

[58] Field of Search ..... 132/201, 200, 132/219, 105, 56, 53

[56] References Cited

U.S. PATENT DOCUMENTS

| | | | |
|---|---|---|---|
| 250,967 | 12/1881 | Presser . | |
| 578,623 | 3/1897 | Borden . | |
| 794,479 | 7/1905 | Austin . | |
| 966,110 | 8/1910 | Matthaus . | |
| 1,346,718 | 7/1920 | Muller . | |
| 1,351,427 | 8/1920 | Krasmauskis . | |
| 1,549,334 | 8/1925 | Ruffio . | |
| 1,714,358 | 5/1929 | Finkelstein . | |
| 2,651,310 | 9/1953 | Selson | 132/48 |
| 3,520,310 | 7/1970 | Witmondt | 132/53 |
| 4,254,783 | 3/1981 | Kim | 132/11 |
| 5,501,239 | 3/1996 | Walker | 132/275 |

OTHER PUBLICATIONS

Product Brochure, Hairdini Inventive Products, Inc., 1998.

*Primary Examiner*—John J. Wilson
*Assistant Examiner*—Robyn Doan
*Attorney, Agent, or Firm*—Pennie & Edmonds LLP

[57] ABSTRACT

The present invention provides a system for adding height to the hair at the crown of a wearer's head, which system is easy to use. The system may comprise two hair inserts which can be identical to each other. Each insert is formed by attaching a natural-looking hair piece to the main bar of a comb. The system is inserted by the wearer gathering the natural hair at the crown of her head, inserting one insert from each side of the gathered hair, such that the teeth of the combs intermesh, frictionally engaging the system in the wearer's hair. Finally, the wearer's natural hair can be arranged over the inserted hair pieces so that the system is completely hidden from view. The system is typically hidden from view beneath the wearer's natural hair. However, as the system incorporates natural or synthetic hair covering the main bars of the combs, if the system should become visible, it will not be greatly noticeable or cause embarrassment to the wearer.

18 Claims, 3 Drawing Sheets

SYSTEM AND METHOD FOR USING HIDDEN HAIR COMBS TO ENHANCE HAIR APPEARANCE

TECHNICAL FIELD

This invention relates to an accessory which gives the impression of a fuller or more appealing head of hair. Specifically, this invention relates to a system and method for using hair combs hidden under the wearer's natural hair to add height to the hair at the crown of the wearer's head, thereby giving the appearance of a fuller head of hair.

BACKGROUND OF THE INVENTION

Some people have thin hair for genetic reasons, others may have thin hair due to illness or certain types of treatment for illness. Furthermore, even among those with hair of average or better fullness, there is an interest, particularly among women, for large, upswept hairstyles. In all of these various cases, there is a need for a system or method to add height to the hairstyle and provide the appearance of greater fullness to people's hair. The feminine pronoun will be used throughout this document, although it is to be understood that the system of the present invention is equally appropriate for use by men and women.

To some extent, the natural hair on a person's head can be given an appearance of increased fullness by appropriate styling. This approach, variously termed pumping, teasing, back combing, etc., is time-consuming and of limited effectiveness. Also, a teased hairstyle will tend to flatten out over the course of a day, requiring re-styling to maintain the desired appearance.

It is known to use accessories in order to provide a fuller look to a head of hair. For example, the most common such known accessory, a hair switch, consists of a switch of natural or artificial hair which terminates at one end in a loop of elastic material. The loop is used to fix the switch to the natural hair of the wearer. The wearer piles her hair up on the top of the head, in which position the hair is held by hair clips or the like. The loop of the hair switch is then buried in the piled up natural hair, and secured, again with hair clips, to the natural hair, so as to give the piled-up hair look of greater volume. This procedure is time-consuming, requires skill for proper implementation, and is only appropriate for certain types of hairstyles in which the hair is worn "up," such as in a bun. Therefore, there is a need in the art for a system for adding height to the hair at the crown of the head, which system is quick and easy to put in and which is compatible with casual naturally draping hairstyles, in which the hair is worn "down."

It is known to use artificial volumizing masses to be inserted beneath the wearer's hair, to give naturally draping hairstyles the appearance of more volume near the crown of the head. For example, the commercially available Poof-dini™ device made by Hairdini Inventive Products, Inc. consists of a shapeable foam pillow affixed to a hair clip. The wearer flips her natural hair forward, affixes the clip to the hair at the crown of the head, near the hair roots, and flips her natural hair back over the device. Although the Poof-dini™ device can give the appearance of a great deal of added volume to the wearer's hair, it suffers the disadvantage that in the event that the natural hair is displaced and the device is rendered visible, the obviously artificial nature of the pillow is very apparent, causing embarrassment for the wearer. Therefore, there is a need in the art for a system for adding height to the hair at the crown of the head, which system incorporates human or natural-looking artificial hair to prevent the embarrassment which would be associated with the inadvertent exposure of an obviously artificial system.

It is also known to use combs with hair attached to them to augment the wearer's natural hair. For example, U.S. Pat. No. 250,967 to Presser shows a comb with an attached mass of artificial hair, particularly to be used for reinforcing scanty front hair with artificial waves. Volumizing systems such as Presser suffer the drawback that the comb is visible, and the hair introduced by such systems lies on top of the natural hair and is thus completely visible. Again, the visibility of the comb makes such systems compatible only with certain hairstyles, and the visibility of the introduced hair tends to make the system more noticeable when the color match between the introduced hair and the natural hair is not perfect. Therefore, there is a need in the art for a system for adding height to the hair at the crown of the head, in which the method of attachment of the system is not visible, and which is designed such that the introduced hair is generally hidden from view beneath the natural hair of the wearer.

Therefore, based on the systems known in the art for volumizing hair, there is a need for a system which is easy to put on, is typically hidden from view beneath the wearer's natural hair, uses either natural or synthetic hair to provide a natural look, which adds height to the hair at the crown of the head, and which is compatible with hair worn down.

SUMMARY OF THE INVENTION

In accordance with the present invention, there is provided an apparatus for enhancing the appearance of a wearer's hair. The apparatus includes first and second inserts, each insert comprising: (i) a comb having a plurality of teeth spaced longitudinally along a main bar, and (ii) a hair piece secured to the comb. The teeth of the first and second inserts frictionally engage in an intermeshing fashion with each other, and also engage at least some portion of the wearer's natural hair therebetween when inserted for use.

The apparatus may be provided wherein the spaces between the teeth of each comb are approximately equal to the width of the teeth of the other comb. Additionally, a tooth at one end of each comb may be made shorter than most or all of the other teeth. The hair pieces may be secured to their respective combs using adhesive, stitching, or any other suitable means.

The invention also provides a method of enhancing the appearance of a wearer's hair. The method may comprise an insertion step, a frictional engagement step, and an arrangement step. The insertion step comprises inserting, from each of the right and left sides of the wearer's natural hair, an insert comprising: (i) a comb having a plurality of teeth spaced longitudinally along a main bar, and (ii) a hair piece secured to the comb. This is followed by the frictional engagement step which comprises frictionally engaging, in an intermeshing fashion, the teeth of the inserts with each other, and also engaging some portion of the wearer's natural hair therebetween, so as to secure the inserts in the wearer's natural hair. Then comes the step of arranging at least some of the wearer's natural hair so as to substantially hide the hair pieces thereunder.

The method may include, before the insertion step, the step of manually gathering the hair that is desired to be engaged between the inserts. This gathering step may be accomplished by the wearer leaning forward and flipping the wearer's natural hair forward, and gathering between the wearer's hands the hair that is desired to be engaged between the inserts.

BRIEF DESCRIPTION OF THE DRAWINGS

The features and advantages of the present invention will become more readily apparent from the following detailed description of the invention in which like elements are labeled similarly and in which.

DETAILED DESCRIPTION

Figure 1:
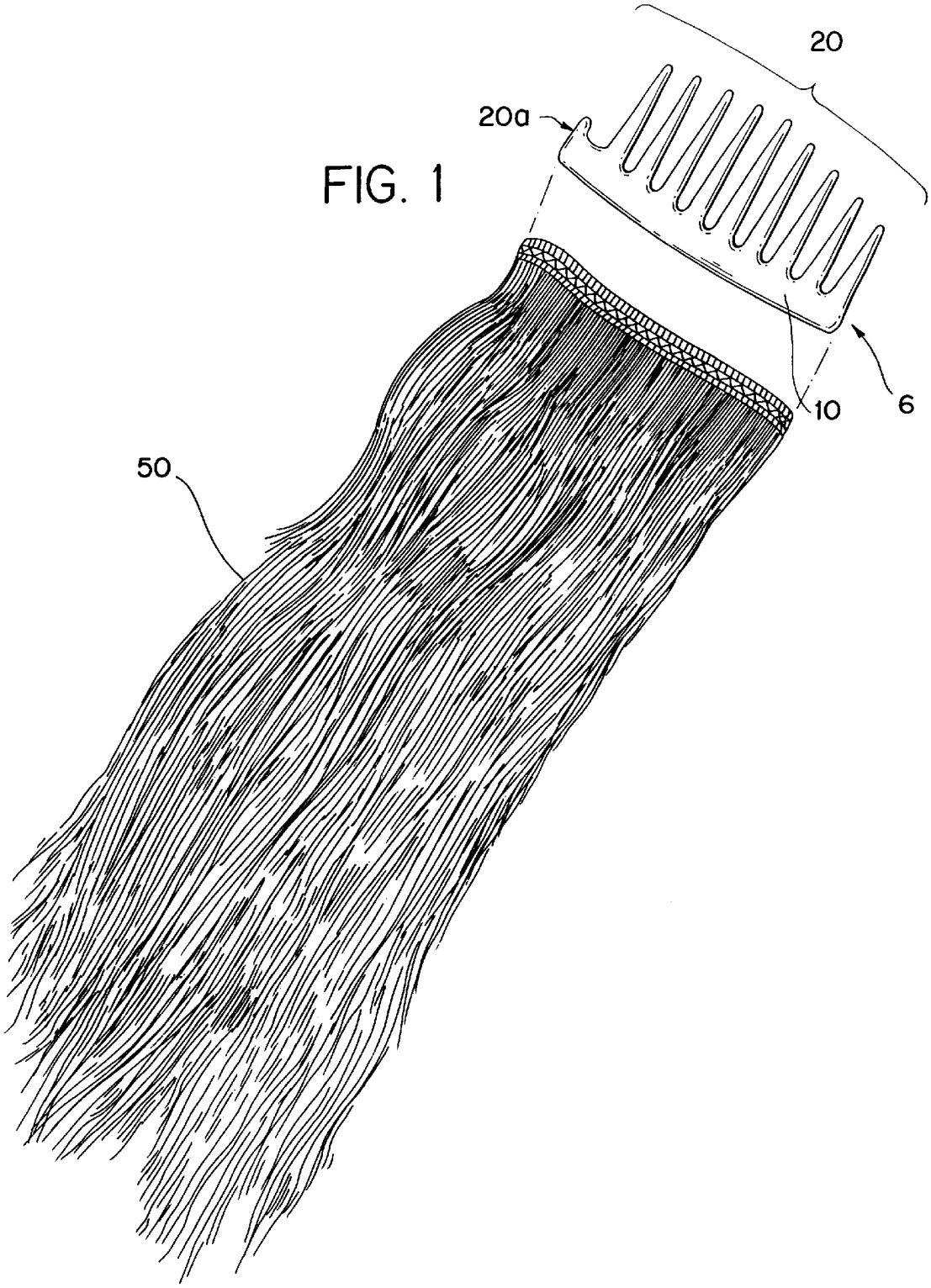
FIG. 1 is a perspective view of an embodiment of the system of the present invention in which the comb and hair piece are not secured to each other.
Figure 2:
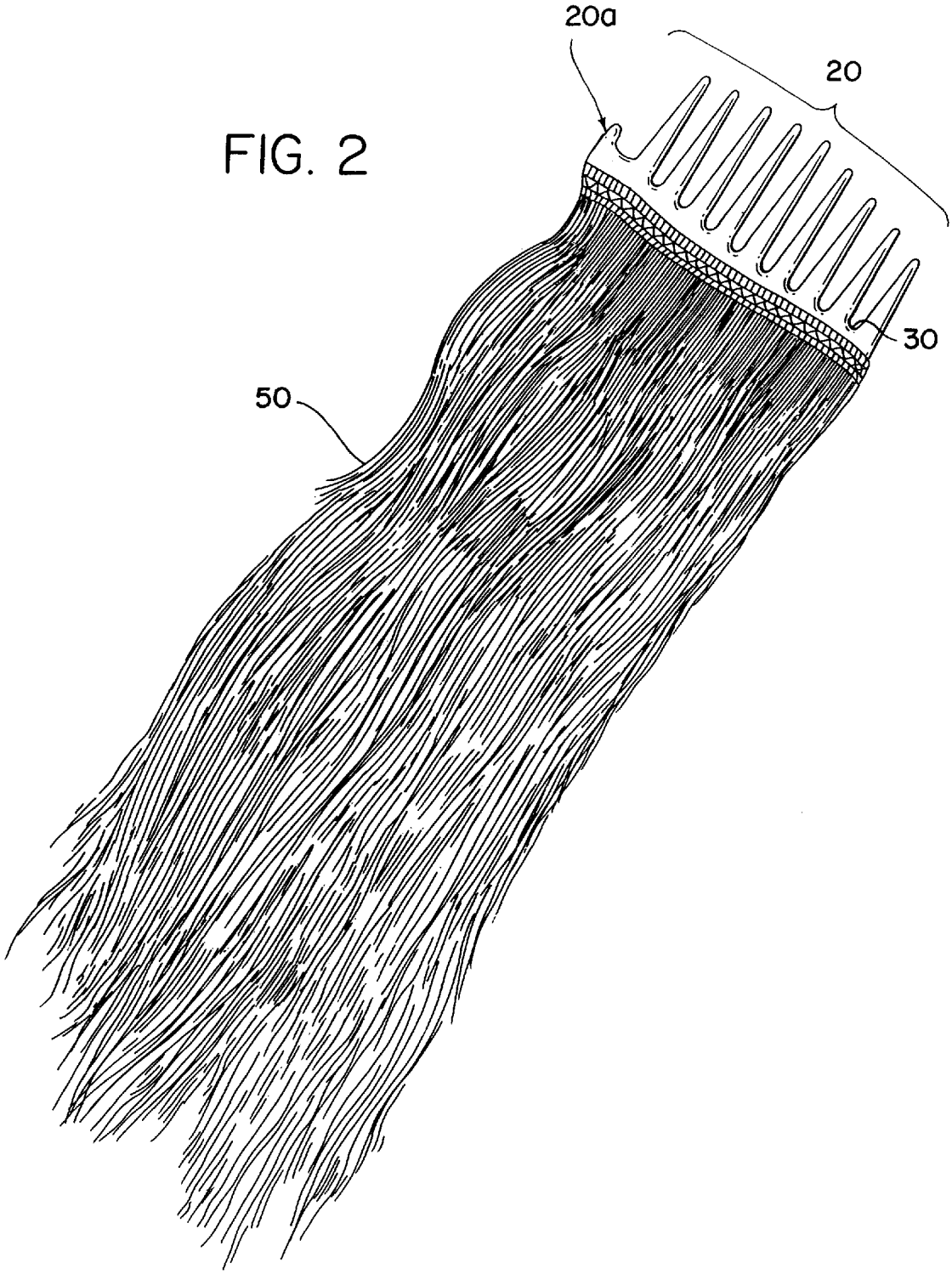
FIG. 2 is a perspective view of an embodiment of the system of the present invention after the comb and hair piece are secured to each other.

Referring to FIGS. 1 and 2, the system comprises a pair of inserts both denominated 2. Although the inserts as illustrated in the drawings are identical to each other, it is to be understood that the invention does not require such similarity. Each inserts consists of a comb 6, and hair piece 50. The combs may be made of any appropriate material, such as metal, wood, or plastic, so as to have moderate flexibility and the desired weight. Each comb has a main bar 10, and a plurality of generally parallel teeth 20, separated by spaces 30. The teeth 20 are generally perpendicular to, and run the length of, main bar 10. Preferably, the width of the teeth 20 and spaces 30 will be approximately equal, for reasons which will become apparent below.

A hair piece 50 is secured to each comb along the main bar 10 by any suitable means, such as adhesives, stitching, etc. If the comb is formed from a plastic material, the hair piece 50 may be embedded in the material of main bar 10 while the comb material is at a sufficiently high temperature to be in a liquid or semi-liquid state, for example during or immediately after the molding process. The hair piece 50 preferably extends along the entire length of the main bar 10. If the hair piece is secured to the comb by stitching, the stitching will preferably encircle the bar, such that the stitching passes through the interstitial space between two successive teeth and around the top of the main bar, thus securely holding the hair piece against any sliding motion relative to the comb.

Figure 3A:
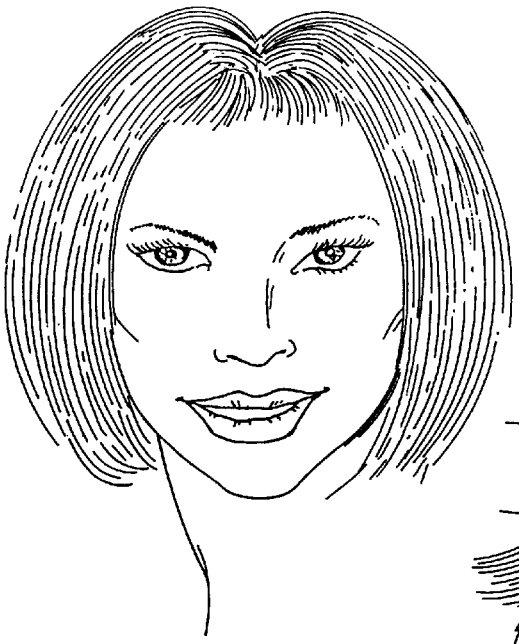
FIGS. 3A–3C are perspective views showing various stages of the method for improving the appearance of the wearer's hair using the system of the present invention.
Figure 3B:
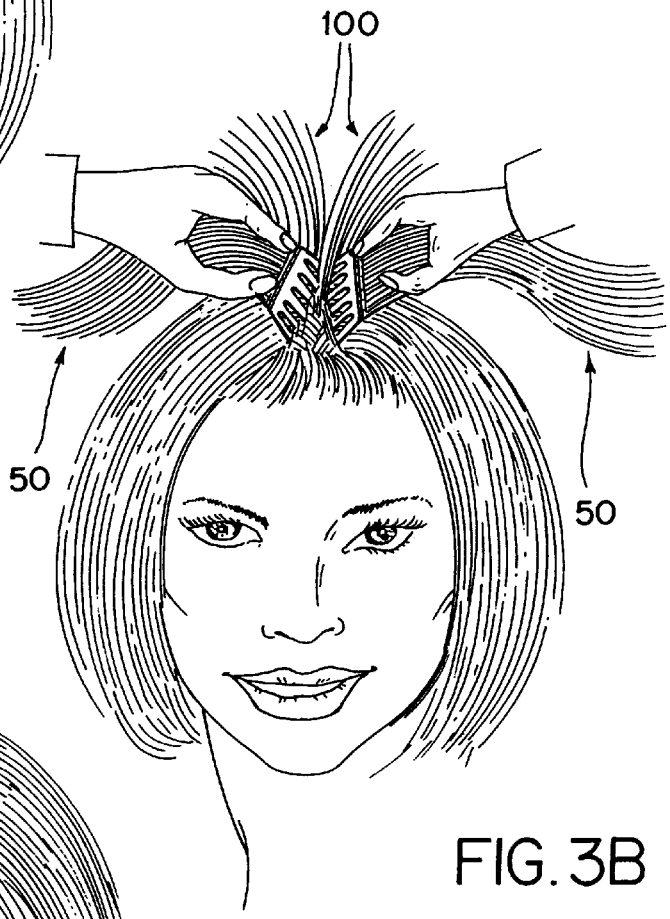
Figure 3C:
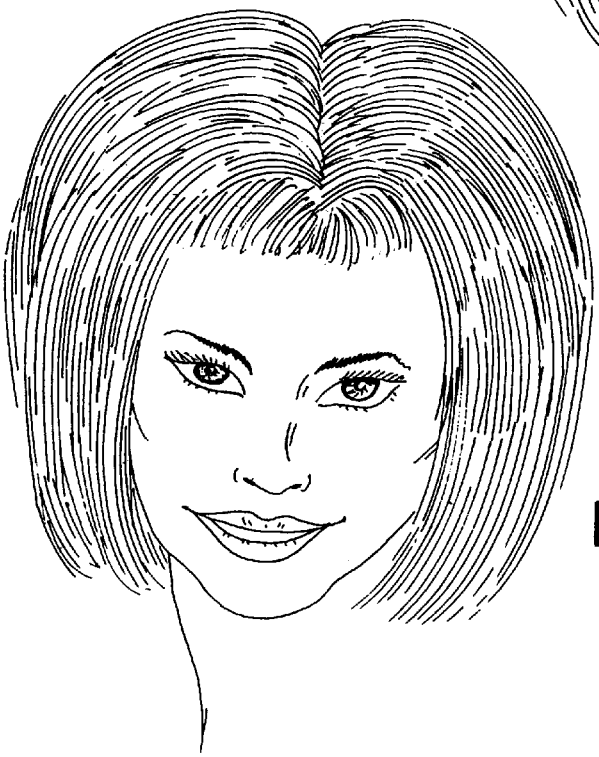

A preferred application of the system of the present invention will be described with reference to a wearer having her hair parted down the middle and worn down, as shown in FIGS. 3A to 3C. The wearer prepares by taking one insert in each hand, with the fingers overlying the comb teeth, and the teeth facing each other. Then, as shown in FIG. 3B, the wearer loosens her natural hair and, placing the tips of her fingers (and thus of the comb teeth) near the crown of her head on either side of the center, flips her head over, such that the hair at the crown of her head between her fingers (hereinafter "the center hair" 100) is flipped forward and is gathered, or situated, between her hands. (For consistency with the other Figures, the wearer's head is not shown flipped over in FIG. 3B. However, it will be understood that the desired gathering of the center hair 100 shown in FIG. 3B is most easily accomplished when the wearer is in fact leaning over.) Then, the hands are brought together towards the centerline of the head, resulting in an frictional intermeshing of the teeth of the combs, with the center hair 100 now being captured by the intermeshing teeth 20. It can be understood that because the teeth 20 of one comb interlocks in the spaces 30 between the teeth of the other comb, it is desired that the spacing 30 between the teeth be approximately equal to the width of the teeth 20. Finally, as illustrated in FIG. 3C, the wearer brings her head back up and adjusts her center hair 100 so as to look natural, and to cover and hide the hair pieces 50. To the extent desired, the wearer may style her hair in styles other than the simple 'down' style as shown in the figures.

With this invention, the wearer quickly and easily achieves the result of a fuller looking head of hair when her hair is worn down. The presence of the combs 6 beneath the hair at the crown of the wearer's head provides additional height to the hair at that area. Because the entire system can be hidden beneath the wearer's natural hair, the effect appears to be attributable to the fullness of the wearer's natural hair. And in the event that the wearer's natural hair is disturbed, for example by wind, such that the system is rendered partially or fully visible, its exposure will not be noticeable if the hair pieces have been selected to match the color of the wearer's natural hair.

It has been found that when all of the comb teeth are of the same length, under certain conditions, the tips of the front teeth may become visible through the wearer's natural hair. Accordingly, it is preferred to form the tooth 20*a* at one end of the main bar somewhat shorter than the other teeth; the combs are then inserted with these short teeth 20*a* toward the front of the head. In this way, when the two combs are intermeshed, the tips of the short teeth 20*a* will extend a shorter distance, relative to the other teeth, from the centerline of the system, thus minimizing the likelihood that the tips of the teeth will inadvertently become visible through the wearer's natural hair. However, it is preferable that the other teeth remain relatively long, so as to provide an adequate length for interacting with the wearer's natural hair, thus securely holding the system in place and providing the desired heightening effect.

The heightening effect provided to the hair at the crown of the wearer's head persists even after the inserts are removed. Therefore, if desired, the inserts of the present system can be worn for some period of time, then removed, and the hair at the crown of the head will retain a residual bouffe for several hours. For example, the wearer could put the system in her hair before retiring for the evening, sleep with the system in her hair, then remove it upon waking up. The residual effect is retained for some time, and can be enjoyed during the day, even without the system actually being present in the hair.

It should be emphasized that the above described embodiment of the present invention is merely one specific example of the novel system. The modifications appropriate for other applications may readily be realized by those who are skilled in the art and who have been equipped with the understanding of the structure and operation of the present invention as set forth in the above description. Accordingly, it should be understood that the embodiment herein is merely illustrative of the principles of the invention. Various modifications may be made by those skilled in the art which will embody the principles of the invention and fall within the spirit and the scope thereof.

I claim:

1. An apparatus for enhancing the appearance of a wearer's hair, the apparatus comprising:

a first and second insert, each insert comprising: (i) a comb having a plurality of teeth spaced longitudinally along a main bar, and (ii) a hair piece secured to the comb; and the teeth of the first and second inserts frictionally, engaging in an intermeshing fashion with each other, and also for engaging at least some portion of the wearer's natural hair therebetween.

2. The apparatus of claim 1 wherein the spaces between the teeth of each comb are approximately equal to the width of the teeth of the other comb.

3. The apparatus of claim 1 wherein a tooth at one end of each comb is shorter than most or all of the other teeth.

4. The apparatus of claim 1 or 2 wherein the hair pieces are secured to their respective combs using adhesive.

5. The apparatus of claim 1 or 2 wherein the hair pieces are secured to their respective combs by stitching.

6. A method of enhancing the appearance of a wearer's hair, comprising the steps of:

inserting, from each of the right and left sides of the wearer's natural hair, an insert comprising: (i) a comb having a plurality of teeth spaced longitudinally along a main bar, and (ii) a hair piece secured to the comb;

frictionally engaging, in an intermeshing fashion, the teeth of the inserts with each other, and also engaging some portion of the wearer's natural hair therebetween, so as to secure the inserts in the wearer's natural hair; and arranging at least some of the wearer's natural hair so as to substantially hide the inserts thereunder.

7. The method of claim 6, further including, before the inserting step, the step of manually gathering the hair that is desired to be engaged between the inserts.

8. The method of claim 7, in which the gathering step is accomplished by the wearer leaning forward and flipping the wearer's natural hair forward, and gathering between the wearer's hands the hair that is desired to be engaged between the inserts.

9. The method of claim 6, wherein the spaces between the teeth of each comb are approximately equal to the width of the teeth of the other comb.

10. The method of claim 6, wherein the tooth at one end of each comb is substantially shorter than most or all of the other teeth.

11. The method of claim 6, wherein the hair pieces are secured to their respective combs using adhesive.

12. The method of claim 6, wherein the hair pieces are secured to their respective combs by stitching.

13. The method of claim 6, further comprising the steps of:

keeping the inserts in the wearer's hair for a period of time;

removing the inserts; and retaining a residual heightening effect.

14. A method of enhancing the appearance of a wearer's hair, comprising the steps of:

manually gathering the portion of the wearer's natural hair that is desired to be engaged between the inserts, by the wearer leaning forward and flipping the wearer's natural hair forward, and gathering between the wearer's hands the portion of the wearer's natural hair that is desired to be engaged between the inserts;

inserting, from each of the right and left sides of the portion of the wearer's natural hair, an insert comprising: (i) a comb having a plurality of teeth spaced longitudinally along a main bar, and (ii) a hair piece secured to the comb;

frictionally engaging, in an intermeshing fashion, the teeth of the inserts with each other, and also engaging the portion of the wearer's natural hair therebetween, so as to secure the inserts in the wearer's natural hair; and arranging at least some of the wearer's natural hair so as to substantially hide the inserts thereunder.

15. The method of claim 14, wherein the tooth at one end of each comb is substantially shorter than most or all of the other teeth.

16. The method of claim 14, wherein the hair pieces are secured to their respective combs using adhesive.

17. The method of claim 14, wherein the hair pieces are secured to their respective combs by stitching.

18. The method of claim 14, further comprising the steps of:

keeping the inserts in the wearer's hair for a period of time;

removing the inserts; and retaining a residual heightening effect.

* * * * *